US006176329B1

(12) United States Patent
Portwood et al.

(10) Patent No.: US 6,176,329 B1
(45) Date of Patent: Jan. 23, 2001

(54) DRILL BIT WITH RIDGE-CUTTING CUTTER ELEMENTS

(75) Inventors: Gary Ray Portwood, Kingwood; J. Albert Sue, The Woodlands, both of TX (US)

(73) Assignee: Smith International, Inc., Houston, TX (US)

( * ) Notice: Under 35 U.S.C. 154(b), the term of this patent shall be extended for 0 days.

(21) Appl. No.: 09/129,582

(22) Filed: Aug. 5, 1998

Related U.S. Application Data

(60) Provisional application No. 60/054,844, filed on Aug. 5, 1997.

(51) Int. Cl.[7] ..... E21B 10/18
(52) U.S. Cl. ..... 175/341; 175/376
(58) Field of Search ..... 175/341, 376, 175/278, 331, 374

(56) References Cited

U.S. PATENT DOCUMENTS

| | | | |
|---|---|---|---|
| 4,202,419 | 5/1980 | Youngblood | 175/374 |
| 4,343,372 | 8/1982 | Kinzer | 175/374 |
| 4,475,606 | 10/1984 | Crow | 175/410 |
| 4,832,139 | 5/1989 | Minikus et al. | 175/374 |
| 4,892,159 | 1/1990 | Holster | 175/336 |
| 5,172,777 | 12/1992 | Siracki et al. | 175/374 |
| 5,172,779 | 12/1992 | Siracki et al. | 175/420 |
| 5,322,138 | 6/1994 | Siracki | 175/374 |
| 5,346,025 | 9/1994 | Keith et al. | 175/57 |
| 5,372,210 | 12/1994 | Harrell | 175/431 |
| 5,415,244 | 5/1995 | Portwood | 175/374 |
| 5,421,424 | 6/1995 | Portwood et al. | 175/374 |
| 5,853,055 * | 12/1998 | Siracki et al. | 175/341 |
| 5,881,829 * | 3/1999 | Dimond et al. | 175/378 |

FOREIGN PATENT DOCUMENTS 1193717 6/1970 (GB) .

* cited by examiner

*Primary Examiner*—William Neuder
(74) *Attorney, Agent, or Firm*—Conley, Rose & Tayon, P.C.

(57) ABSTRACT

A drill bit for cutting a formation that tends to form ridges comprises: a bit body having a bit axis, a plurality of rolling cone cutters rotatably mounted on the bit body, with each rolling cone cutter having a generally conical surface, a plurality of primary cutter elements extending from one of the cone cutters in a first row, each primary cutter element having an outer side and an inner side, and a plurality of ridge-cutting cutter elements extending from the same cone cutter, the first plurality of ridge-cutting cutter elements being positioned adjacent to the outer side of the first row of primary cutter elements. Each ridge-cutting cutter can be, but is not necessarily, on the same cone cutter as the primary cutter element adjacent to which it cuts, and is preferably positioned on a land or flat adjacent to that primary cutter element. Each primary cutter element in one or more rows can be provided with a ridge-cutting cutter element and the ridge-cutting cutter element can be angled with respect to the axis of the primary cutter element.

59 Claims, 9 Drawing Sheets

11
10
13
17
17
19
19
18
12
12
50
44
44
61
60
48
46
49
14
16
15
90
46
48
70
71

DRILL BIT WITH RIDGE-CUTTING CUTTER ELEMENTS

RELATED APPLICATIONS

The present application claims the benefit of 35 U.S.C. 111(*b*) provisional application Ser. No. 60/054,844 filed Aug. 5, 1997, and entitled Kerf Cutter.

TECHNICAL FIELD OF THE INVENTION

The present invention relates to roller cone drill bits having cutter elements that are adapted to reduce the growth of ridges between adjacent kerfs on the borehole bottom. More particularly, the present invention comprises the inclusion of at least one ridge-cutting cutter element adjacent at least one primary cutting element, with the ridge-cutting element preferably having a reduced height and being inclined with respect to the axis of the primary cutting element with which it is associated.

BACKGROUND OF THE INVENTION

Roller cone drill bits create an uncut region on the bore hole bottom known in the art as "uncut bottom." This is the region on the bore hole bottom that is not contacted by the primary row cutter elements. Primary row cutter elements are the cutting elements that project the furthest from the cone body for cutting the bore hole bottom. If this uncut area is allowed to build up, it forms ridges. As used herein, the term "ridge" means the uncut formation material that remains between the kerfs cut by adjacent rows of cutter elements as the bit is rotated in the borehole. In some drilling applications, ridges are not significant, because the formation that would form the ridges is easily fractured and ridges do not tend to build up. By contrast, in rock formations that are not easily fractured, or when the formation becomes plastic under the high down hole pressure, ridges tend to build up. The formation of ridges is detrimental to the drill bit, as it causes wear on the cone body and cutter elements, and slows the drill bit rate of penetration.

The increasing use of down hole motors with bent housings and/or bent subs in the drill string assembly for directional drilling introduces a wear characteristic where the outer surface of individual cutter elements becomes heavily worn, while the inner surface reflects relatively little wear. As used herein, "outer surface" refers to the side or edge of the cutter element that is closest to gage when the cutter element is at its closest approach to the side wall. Correspondingly, as used herein "inner surface" refers to the side of the cutter element that is closest to the bit centerline when the cutter element is at its closest approach to the side wall. This wear characteristic is particularly caused by the drilling application wherein the drill string is rotated and a bend is employed in the motor housing, which typically can have an angle from 1 to 3 degrees. This causes the circumference of the borehole to increase and causes the ridges that are formed on the borehole bottom to be circumferentially longer than those formed by a bit used without a bent motor housing attached to the drill string assembly. If the ridges are not fractured, the outer surface of the cutter elements encounters increased lateral loads. This leads to excessive wear on both the cutter elements and the cone body. This excessive wear will ultimately lead to breakage or loss of the cutter elements.

Furthermore, the flow of high pressure, abrasive fluid (drilling mud) out of and across the face of the bit causes high rates of bit erosion, particularly in areas where fluid flow is relatively rapid. Channeling of the fluid between cutter elements and recirculation of the fluid around the cutter elements can result in localized rapid fluid flow and undesirable localized erosion.

Hence, it is desired to provide a drill bit that ensures the fracture of the ridges and thereby decreases the wear on the outer surfaces of the cutter elements and on the cone body. It is further desired to provide a bit that mitigates the erosive effect of channelized fluid flow on the bit.

SUMMARY OF THE INVENTION

The present invention provides a means to cut the ridges that otherwise may be formed in the uncut area of the bore hole bottom, and a means to provide support to the outer surface of the primary cutter elements which encounter increased lateral loads when the drill bit is used with a down hole motor.

According to the invention, ridge-cutting cutter elements are secured to the cone cutter body and positioned near the primary cutter elements. The ridge-cutting cutter elements may be hard metal inserts having protruding portions extending from base portions that are secured in the cone cutter, or may comprise steel teeth that are milled, cast, or otherwise integrally formed from the cone material. In either case, the present ridge-cutting cutter elements are positioned on the cutter body in the areas between primary cutter elements where ridges may tend to build up, or are positioned to provide support to the outer surface of the primary cutter elements. The ridge-cutting cutter element's protruding portion can be any shape such as: conical, chisel, round, or flat. It is preferred that the cutting portion have cutting edges to aggressively cut the ridge. Also, an individual cutter element can be rotated about its longitudinal axis so as to provide a more effective cutting action. For example, a chisel insert that is used to cut a ridge can be rotated to have its elongated crest positioned circumferentially on the cone cutter.

Another benefit can be realized by placing the ridge-cutting cutter element adjacent to the primary cutter element. In this embodiment, the protruding portion of the ridge cutter element can have a flank or edge positioned to divert the drilling fluid away from the cone material that is supporting the primary cutter element. This prevents excessive erosion around the primary cutter element.

BRIEF DESCRIPTION OF THE DRAWINGS

For a detailed description of a preferred embodiment of the invention, reference will now be made to the accompanying Figures, wherein.

DETAILED DESCRIPTION OF THE PREFERRED EMBODIMENTS

Figure 1:
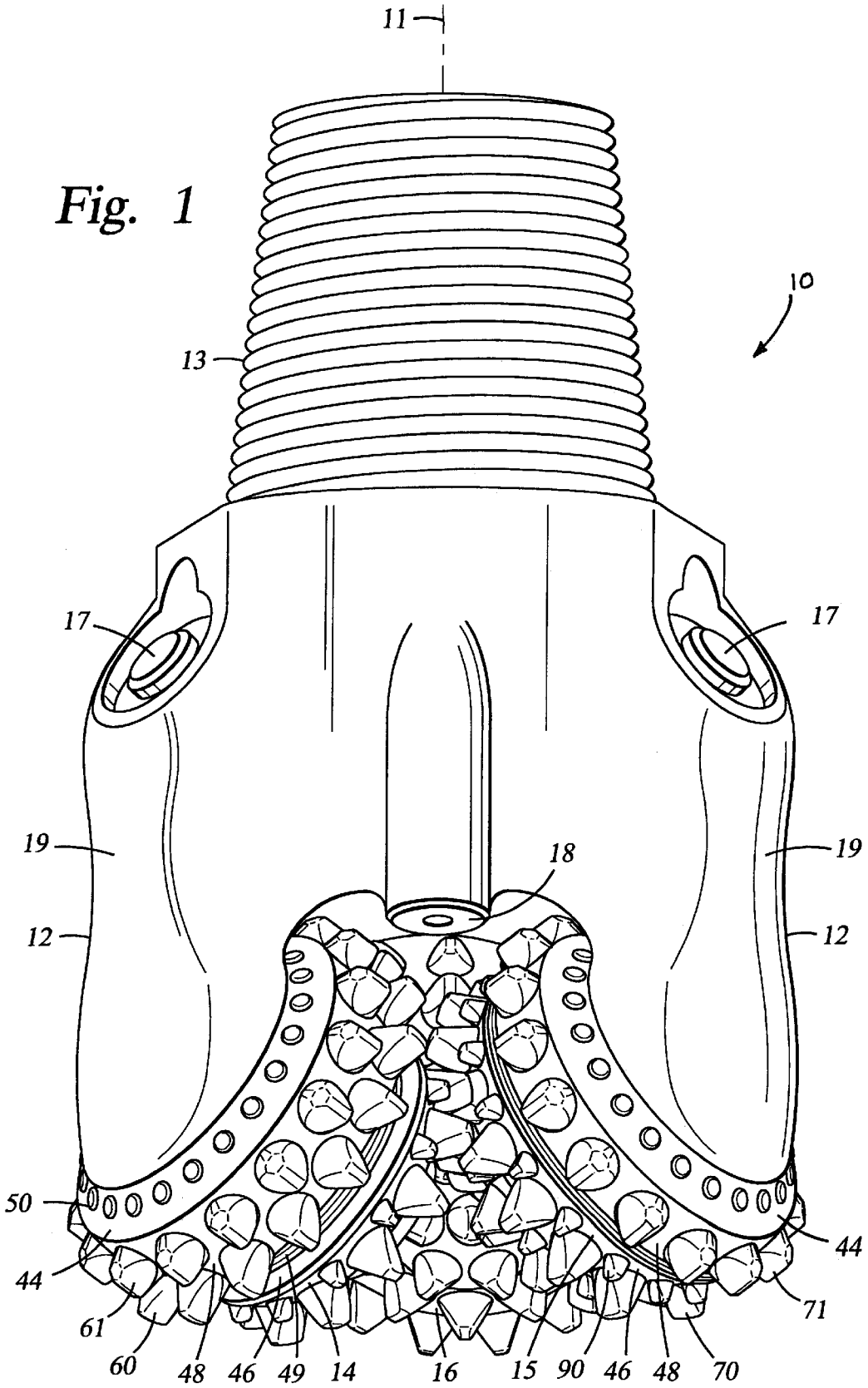
FIG. 1 is a perspective view of a three-cone roller cone bit constructed in accordance with the present invention.

Referring to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15 16 rotatably mounted on bearing shafts that depend from the bit body 12. Bit body 12 is composed of three sections or legs 19 (two shown on FIG. 1) that are welded together to form bit body 12. The bit further includes a plurality of nozzles 18 that are provided for directing drilling fluid toward the bottom of the bore hole and around cutters 14–16. Bit 10 further includes lubricant reservoirs 17 that supply lubricant to the bearings of each cutter.

Figure 2:
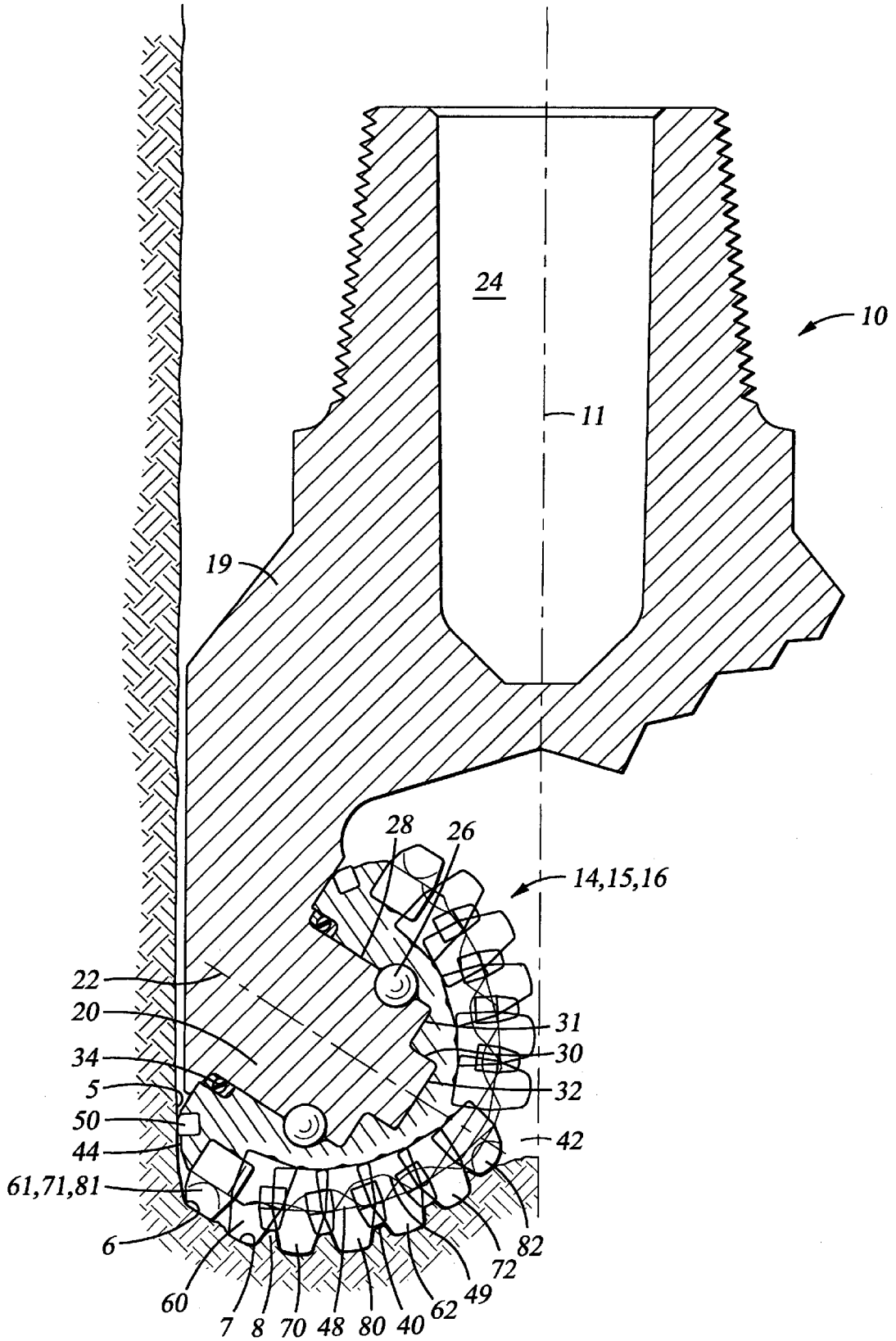
FIG. 2 is a partial section view of one leg and bearings of the bit of FIG. 1, shown with the cutter elements of all three roller cone cutters revolved into a single plane.

Referring now to FIG. 2 in conjunction with FIG. 1, each cone cutter 14–16 is rotatably mounted on a cantilevered pin or journal 20, with an axis of rotation 22 orientated downwardly and inwardly toward the center of the bit. Drilling fluid is pumped from the surface through fluid passage 24, where it is circulated through an internal passageway (not shown) to nozzles 18 (FIG. 1). Each cutter 14-16 is typically secured on pin 20 by ball bearings 26. In the embodiment shown, radial and axial thrust loads are absorbed by journal surfaces 28, 30, and thrust surfaces 31, 32; however, the invention is not limited to use in a journal or "friction" bearing bit, but may equally be applied in a roller bearing bit. In both friction bearing and roller bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2.

Referring still to FIGS. 1 and 2, each cutter 14–16 includes a backface 40 and nose portion 42 spaced apart from backface 40. Cutters 14–16 each further include a frustoconical heel surface 44 that is adapted to retain cutter elements 50 that scrape or ream the sidewall of the borehole as cutters 14–16 rotate about the borehole bottom.

Extending between heel surface 44 and nose 42 is generally conical surface 46 adapted for supporting cutter elements that gouge or crush the bore hole bottom 7 as the cutters rotate about the bore hole. Conical surface 46 typically includes a plurality of generally frustoconical segments 48 referred to as "lands," which are employed to support and secure the cutter elements. Grooves 49 are formed in cone surface 46 between adjacent lands 48.

Cone cutters 14,15,16 include a plurality of heel row inserts 50 that are secured in a circumferential row in the frustoconical heel surface 44. Cutter 14 further includes a circumferential row of gage inserts 61 secured thereto. Similarly, cone cutters 15,16 include gage row cutter elements 71,81 respectively. Cutters 14,15,16 further include a plurality of inner row inserts 60,70,80, respectively, secured in circumferential rows in cone surface 46. As used herein, the term "inner row" refers to those rows of primary cutter elements that between the gage row and the nose row on each cone cutter. Cutters 14,15,16 further include a nose row of inserts 62,72,82. Insert 82, as shown in FIG. 2, is a single insert, but is known in the art as a nose row insert, the nose row on a cone cutter being defined as the row farthest from the gage row. Gage row inserts 61 and each of the inner row inserts 60, 70, 80 and the nose row inserts 62, 72, 82 are considered primary cutter elements for purposes of the present invention.

Cutter elements are typically arranged on conical surface 46 so as to "intermesh." More specifically, performance expectations require that the cone bodies be as large as possible within the borehole diameter so as to allow use of the maximum possible bearing size and to provide adequate recess depth for cutter elements. To achieve maximum cone cutter diameter and still have acceptable insert protrusion, some of the rows of cutter elements are-arranged to pass between the rows of cutter elements on adjacent cones as the bit rotates. In some cases, certain rows of cutter elements extend so far that clearance areas corresponding to these rows are provided on adjacent cones so as to allow the primary cutter elements on adjacent cutters to intermesh farther. The term "intermesh" as used herein is defined to mean overlap of any part of at least one primary cutter element on one cone cutter with the envelope defined by the maximum extension of the cutter elements on an adjacent cutter.

Furthermore, while a preferred embodiment of the present invention is disclosed with respect to cutter elements that comprise hard metal inserts, the concepts of the present invention are equally applicable to bits in which the cutter elements are other than inserts, such as steel tooth bits.

In the embodiment of the invention shown in FIGS. 1 and 2, each cutter 14–16 includes a plurality of ridge-cutting inserts 90 extending from the outer surface of each land 48 and positioned near the rows that contain inserts 70,80,62, 72, the outer surface of the land 48 being defined as the edge that is closest to gage. Inserts 90 are positioned in cone cutters 14,15,16 so as to cut the portions of the hole bottom 7 that are left uncut by inserts 60, 70, 80, 62, and 72.

As explained previously, the certain characteristics of the material forming hole bottom 7 can lead to the build up of ridges 8 thereon. If ridges 8 are allowed to build up, they can detrimentally affect the working life of the inner and nose row cutter elements. Drilling applications that employ rotation of the drill string in conjunction with a downhole motor incorporating a bent housing and/or bent sub cause the ridges 8 to be more pronounced, as best explained with reference to FIGS. 3–5.

Figure 3:
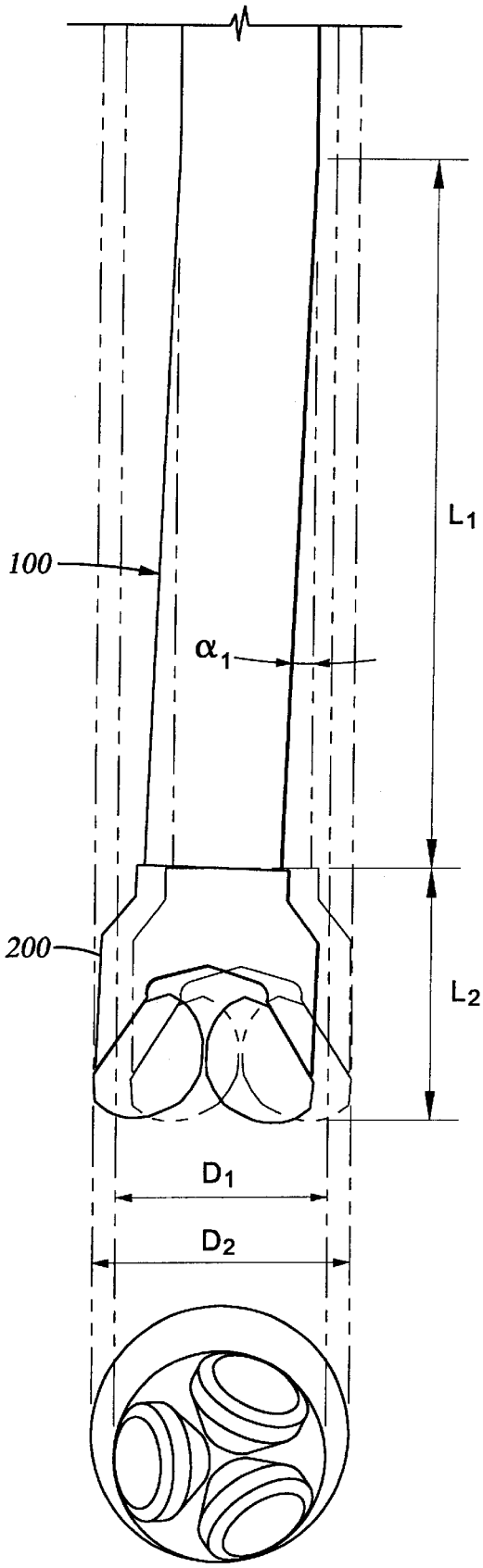
FIG. 3 is a side view of a prior art earth boring bit attached to a bent-housing downhole motor, with the same components positioned at a different phase of the drilling cycle shown in phantom.

Referring to FIG. 3, a conventional earth boring bit 200 attached to a bent housing down hole motor 100 is shown. Bit 200 does not employ ridge-cutting inserts 90 of the present invention. The motor 100 is attached to a drill string (not shown). The bit 200 has a designed diameter $D_1$. The resulting bore hole diameter $D_2$ is the result of motor 100, which has a bend angle $\alpha_1$, angled length $L_1$ (the length of the bent housing) and bit length $L_2$. The exact resulting bore hole diameter $D_2$ also depends on rock formation properties, the presence or absence of additional down hole tools added to the drill string assembly, and the drill string's stability.

Figure 4:
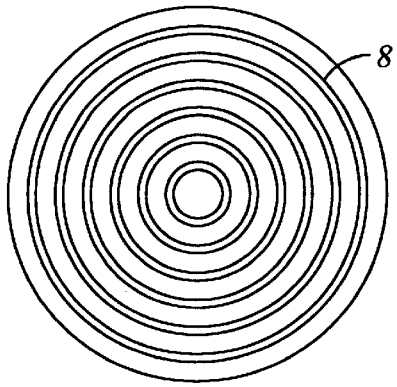
FIG. 4 is a schematic view of a pattern of ridges formed on the borehole bottom when drilling with a conventional three-cone roller cone bit and without a bent housing.
Figure 5:
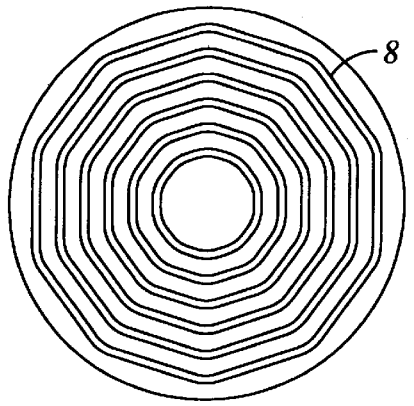
FIG. 5 is a schematic view of a pattern of ridges formed on the borehole bottom when drilling with a conventional three-cone roller cone bit and while rotating drill string and bent downhole assembly.

Referring to FIG. 4, the shaded portions represent the ridges 8 that would be formed on the bore hole bottom 7 by bit 200 if it were to be used either without a bent-housing motor 100, or with a motor 100 but, in this instance, without rotating the drill string. Now referring to FIG. 5, the shaded portion represents the ridges 8 that would be formed on the borehole bottom 7 by bit 200 if it were used with a bent-housing motor 100 and with the drill string rotating. As shown in FIG. 5, the ridges 8 formed by bit 200 and motor 100 are circumferentially longer and therefore have a greater surface area than the ridges shown in FIG. 4.

The enlarged circle of ridges 8 shown in FIG. 5 represents the movement on hole bottom 7 of the inner row inserts 60,70,80 and nose row inserts 62,72,82. This movement causes sliding and higher lateral loads on the outer surfaces of the inner and nose row insert.

Figure 6:
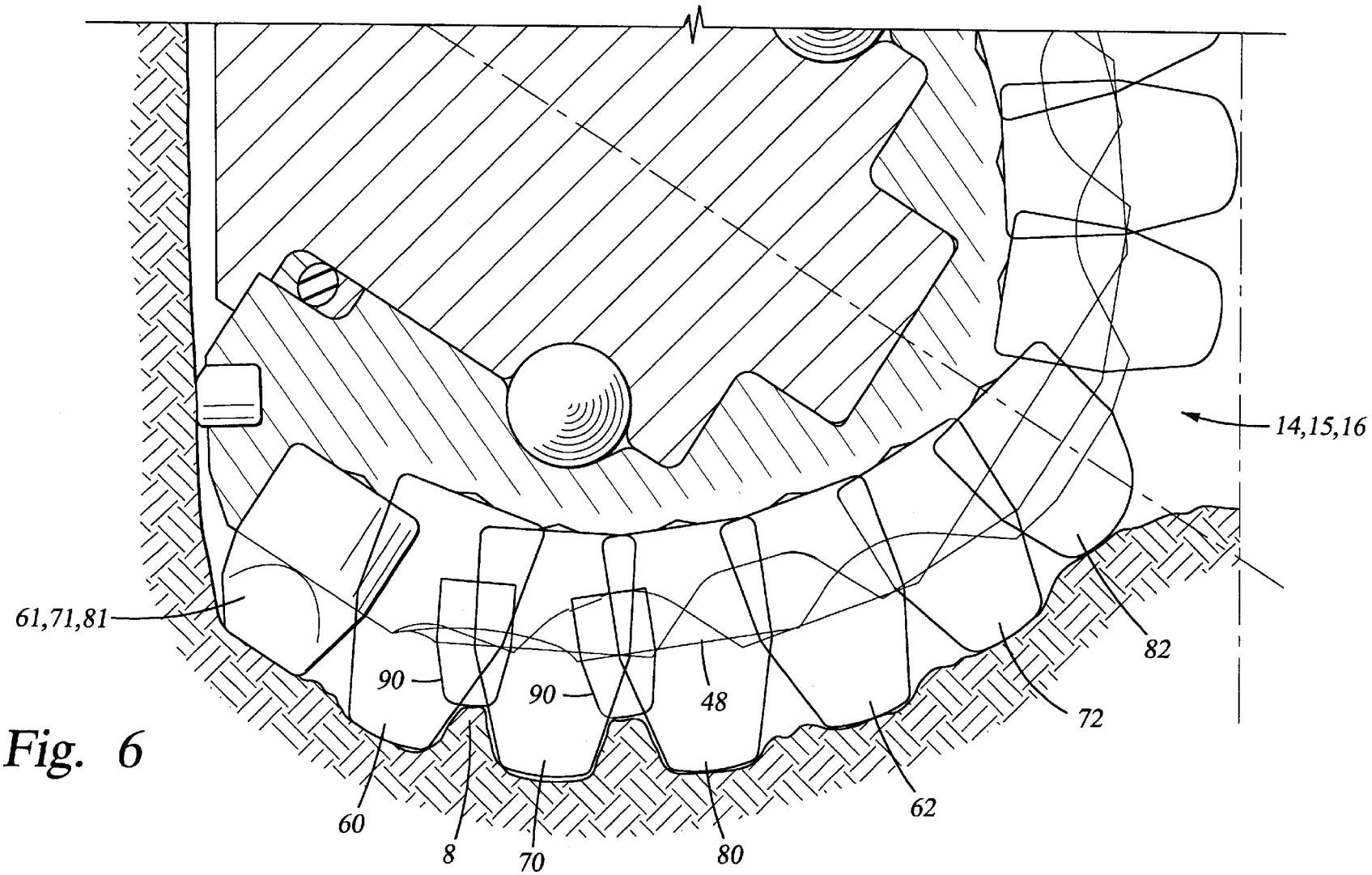
FIG. 6 is a side section view of a preferred embodiment of the present bit, shown with the cutter elements of all three roller cone cutters revolved into a single plane.

FIG. 6 shows a first preferred embodiment of the present invention, showing the preferred location of ridge-cutting inserts 90 on the rolling cone cutters 14,15,16 of bit 10. Inserts 90 are positioned on the outer surface of inner row insert lands 48, and at least one insert 90 is positioned on the circumferential inner rows that contain primary inserts 70,80. In rock formations that are easily fractured, a ridge 8 is less likely to be formed between the rows that contain inserts 80,62,72,82, because the ridge would be relatively small in cross-sectional area and would be easily fractured. By contrast, the ridges 8 formed between the rows that contain inserts 60,70,80 are larger in cross-sectional area and more difficult to fracture. Also, a ridge 8 is less likely to be formed between the rows that contain gage inserts 61,71,81 and insert 60, because the large number or "redundancy" of the gage inserts 61,71,81 tends to prevent a ridge from building up.

Each ridge-cutting cutter element 90 is preferably, but not necessarily, on the same cone cutter as the primary cutter element adjacent to which it cuts. At least one ridge-cutting cutter element is preferably provided for each row of primary cutter elements, and preferably each primary cutter element in a given row is provided with an associated ridge-cutting cutter element.

Figure 6A:
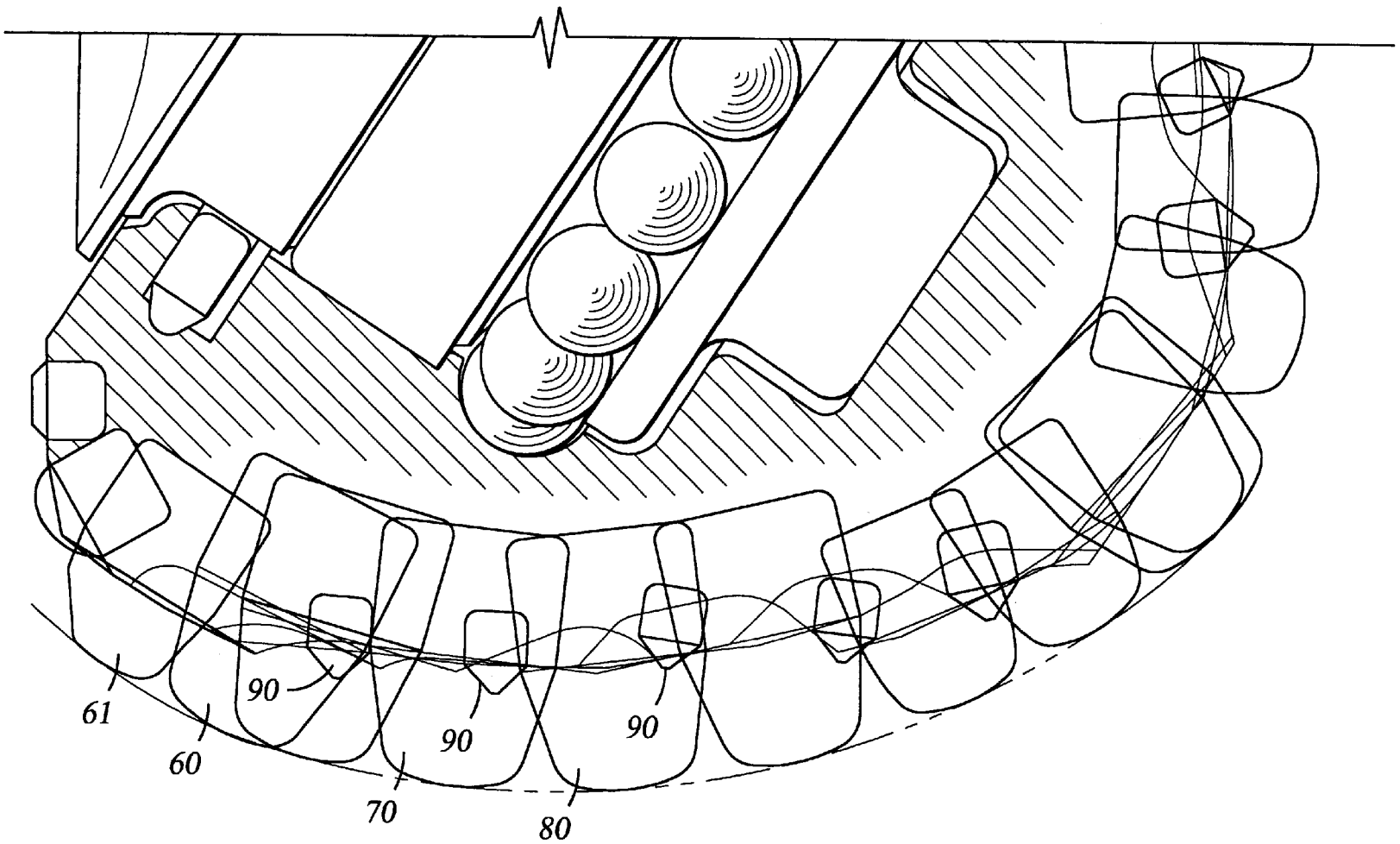
FIG. 6A is a side section view of an alternative embodiment of the present bit, shown with the cutter elements of all three roller cone cutters revolved into a single plane.

It will be noted that in the preferred embodiment shown, the primary cutter elements 60, 70, 80 overlap near the base of their extending portions when revolved into a single plane. It has been discovered that ridge-cutting cutter elements 90 can advantageously be provided to cut ridge 8, not only when the portions of the primary cutter elements that extend past the surface of the cone overlap, as shown, but also when only the bases of the primary cutter elements overlap, and when the extending portions of the cutter elements do not overlap. It has further been discovered that ridge-cutting cutter elements 90 can be used to provide support for the primary cutter elements when increased lateral loads are encountered. Lateral support can be provided even when the ridge-cutting cutter element in question is wholly overlapped by a primary cutter element when they are revolved into a single plane. As used herein, the term "eclipsed" refers to this configuration, namely where the outline of the projecting portion of the ridge-cutting cutter element in question lies wholly within the outline of a primary cutter element when they are revolved into a single plane. An example of this concept is shown in FIG. 6A.

Figure 7:
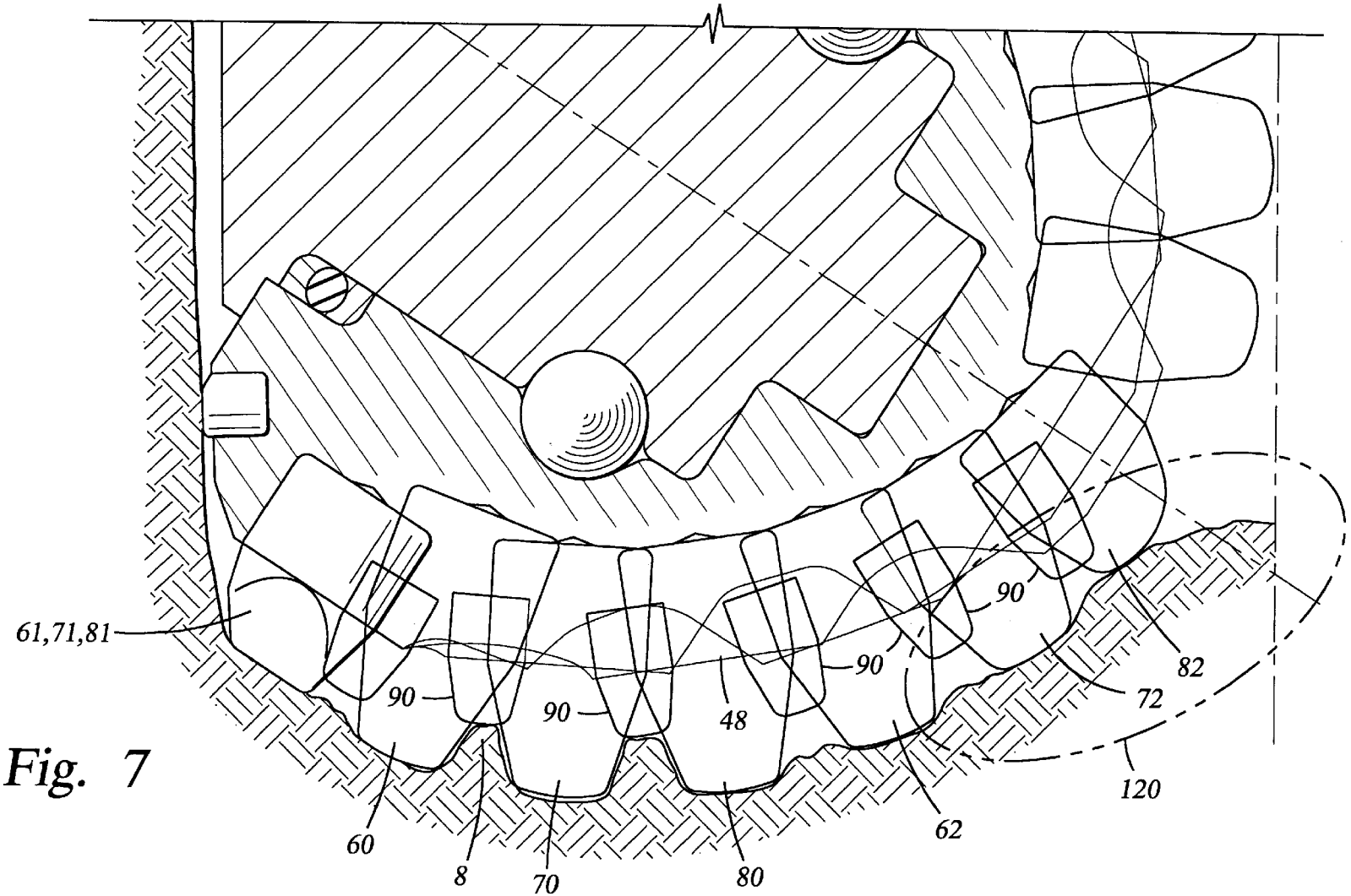
FIG. 7 is a side section view of another alternative embodiment of the present bit, shown with the cutter elements of all three roller cone cutters revolved into a single plane.

FIG. 7 shows a second preferred embodiment of the present invention, showing ridge-cutting inserts 90 positioned on all inner row and nose insert lands 48 so as to cut all the ridges 8 between all the primary insert rows. This is a benefit when the rock formation is relatively plastic and the ridges 8 are not easily fractured. The position of insert 90 can vary, including being on the inner surface or outer surface of lands 48, or elsewhere on the cone, but is more preferably located on the outer surface of lands 48. The inner surface is the side that is closest to the bit center and the outer surface is the side that is closest to gage. For example, insert 90 can be placed on the inner surface of land 48 that supports gage insert 61,71,81. The positioning of ridge-cutting inserts 90 on the inner surface is especially a benefit for nose rows that contain nose inserts 62,72. A rock formation core 120 (area circled) can otherwise form around this area which causes increased wear on the inner end of nose inserts 62,72,82. Insert 90 can also be placed on both the inner and outer surface of a single insert land 48 as in the case shown on land 48 that supports nose insert 72 as shown in FIG. 7.

Figure 8:
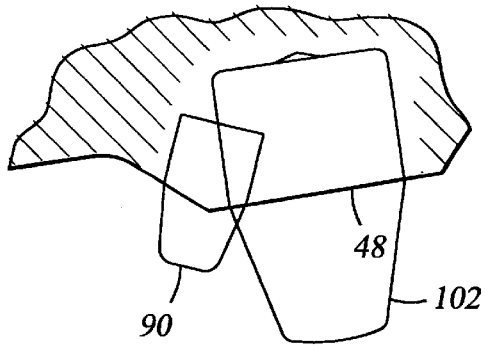
FIG. 8 is an enlarged schematic view of a ridge-cutting cutter element mounted adjacent to a primary cutter element in accordance with the present invention.
Figure 9:
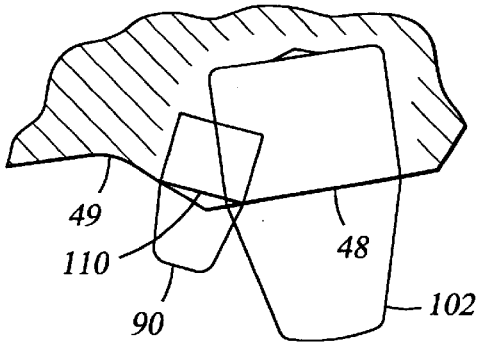
FIG. 9 is an enlarged schematic view of a first alternative embodiment of the ridge-cutting cutter element mounting shown in FIG. 8.
Figure 10:
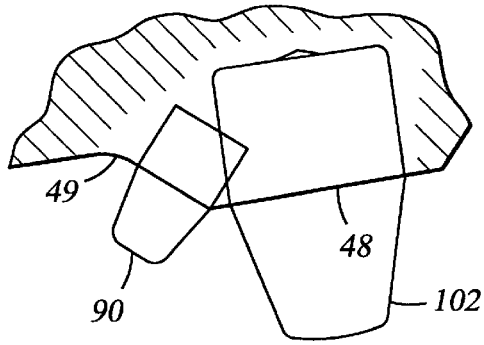
FIG. 10 is an enlarged schematic view of a second alternative embodiment of the ridge-cutting cutter element mounting shown in FIG. 8.

FIG. 8 shows a preferred embodiment of the present invention, showing ridge-cutting cutter element 90 angled so that its longitudinal axis is not parallel to the axis of a primary cutter element 102. More specifically, according to a preferred embodiment, ridge-cutting cutter element 90 is positioned such that its axis defines an angle of between 10 and 90 degrees with respect to the axis of the adjacent primary cutter element 102. Cutter element 102 represents any of the primary inserts on cone cutters 14–16 to which this embodiment can be applied. FIG. 9 shows a milled or cast, substantially flat region 110 (referred to as a "flat") between land 48 and groove 49 . FIG. 10 shows that insert 90 can be placed in the groove 49 and need not be mounted on land 48 or flat 110. Positioning insert 90 on cone surfaces adjacent to land 48 allows increased clearance between the primary inserts 102 and increased intermesh clearance between the adjacent cone cutters 14,15,16. It will be understood that insert 90 can be positioned on any surface adjacent or near land 48 that supports the primary inserts and still gain benefit of this invention.

Figure 12:
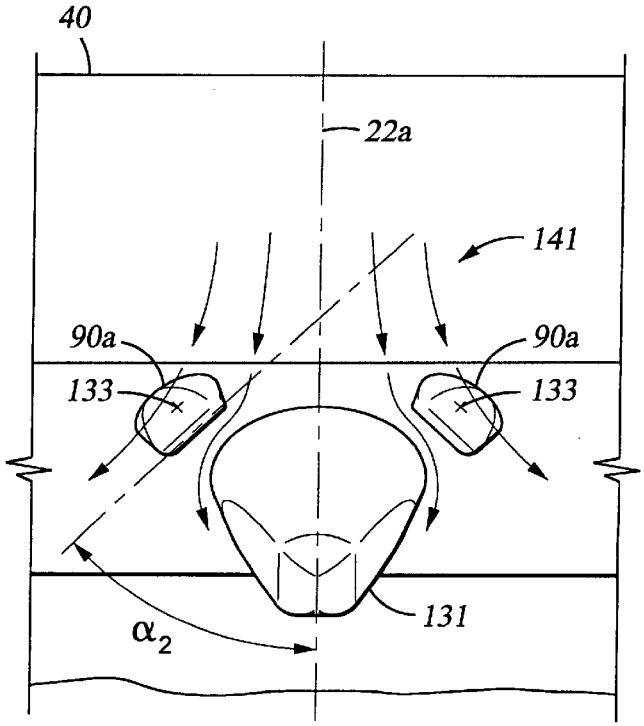
FIG. 12 is an enlarged view of another alternative embodiment of the present invention.
Figure 11:
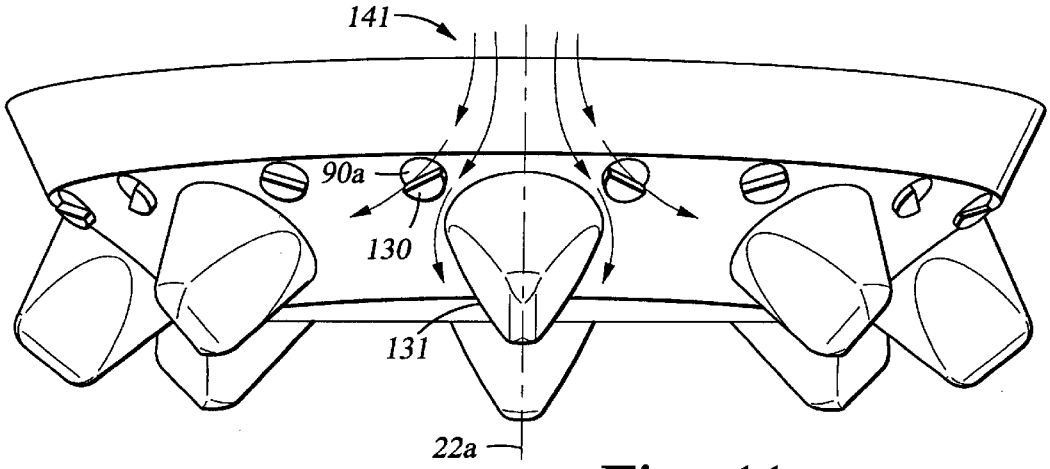
FIG. 11 is an enlarged perspective view of part of a cone cutter constructed in accordance with an alternative embodiment of the present invention.

FIG. 11 shows another preferred embodiment of the present invention, showing the protruding geometry of ridge-cutting insert 90*a* having a fluid-diverting edge 130 aligned to divert a portion of the drilling fluid 141 away from the primary insert 131. Insert 131 represents any of the primary inserts 61,71,81,60,70,80,62,72,82 to which this embodiment can be applied. The protruding geometry can have the shape shown in FIG. 12. FIG. 12 shows a ridge-cutting insert 90*a* with an elongated crest that is rotated by angle $\alpha_2$ in order to align its flank 133 so as to divert the drilling fluid away from primary insert 131. Angle $\alpha_2$ can be between 0 to 90 degrees, but it is preferred to be between 20 and 60 degrees (as measured relative to a projection 22*a* of cone axis 22). It is to be understood that insert 90*a* can be any shape as long it provides a means to divert a portion of the drilling fluid away from the primary cutter elements. This feature is particularly advantageous when a drill bit incorporates a center jet. The use of a center jet increases drilling efficiency due to effective cleaning of the cone cutters, particularly around and between the cutter elements. However, the center jet fluid column 141 (shown in FIG. 13) carries abrasive particles, which causes erosion of the cutter element's supporting material, particularly in the area of fluid impingement.

Figure 14:
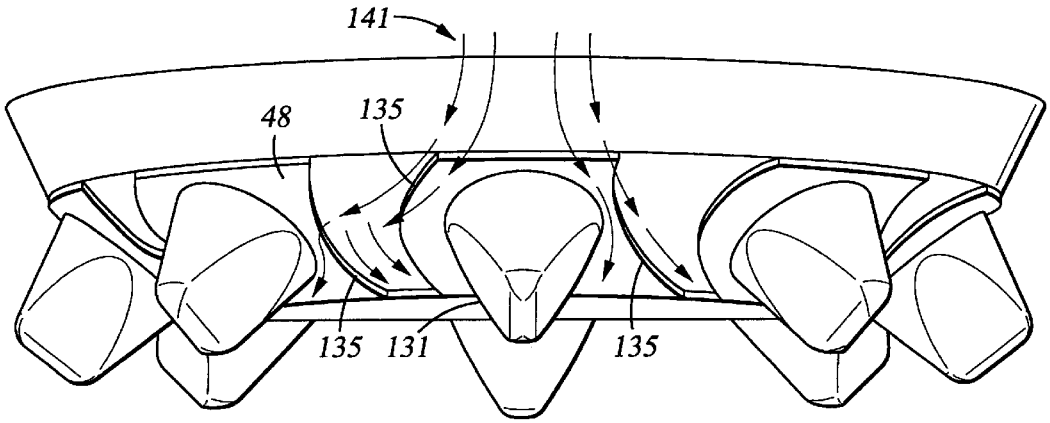
FIG. 14 is an enlarged view of part of a second alternative embodiment of a cone cutter constructed in accordance with the present invention.
Figure 13:
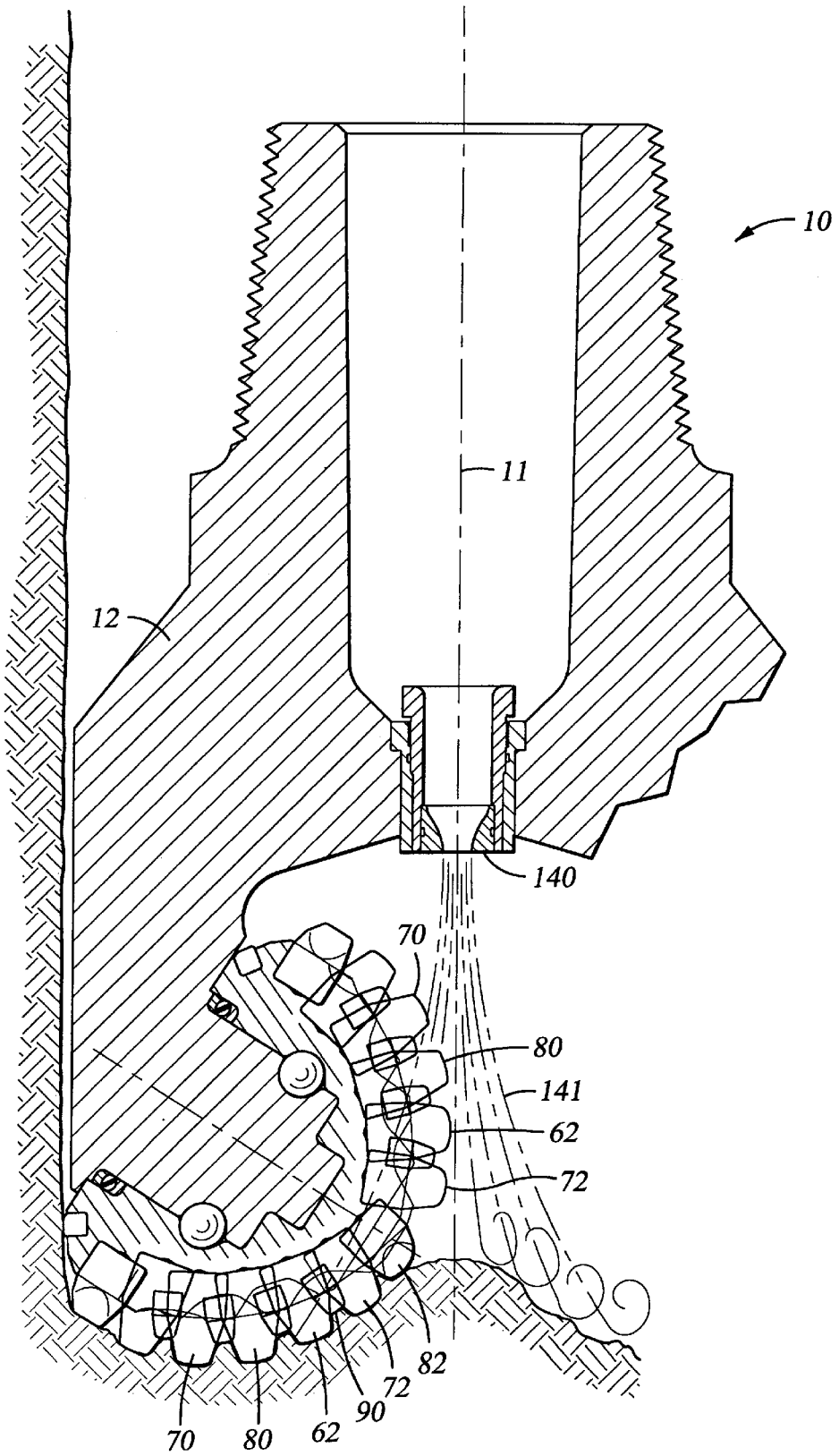
FIG. 13 illustrates the fluid flow across one embodiment of the bit of FIG. 2.

Now referring to FIG. 13, bit 10 has a center jet 140 attached in bit body 12 and aligned with bit axis 11. The centerjet 140 directs a fluid column 141 on cone cutters 14–16. As fluid column 141 contacts the cutter elements 70,80,62,82, it causes the fluid column 141 to recirculate around the insert. Without the use of cutter elements 90*a* of FIGS. 11 or 12, the fluid would accelerate erosion of the supporting material (the cone material supporting the cutter elements) which can lead to loss of the cutter elements. Referring again to FIG. 11, the protruding edge 130 of insert 90*a* diverts a portion of the fluid column 141 (shown as arrows) to help disrupt or break up this recirculating pattern and thus reduce erosion. Another means to break up this recirculating pattern is shown in FIG. 14. A diverting edge 135 is integrally formed in land 48 of the cone cutter to divert a portion of the fluid column 141. The diverting edge 135 can also be formed by a protrusion on the core surface, such as a weld application.

Figure 15:
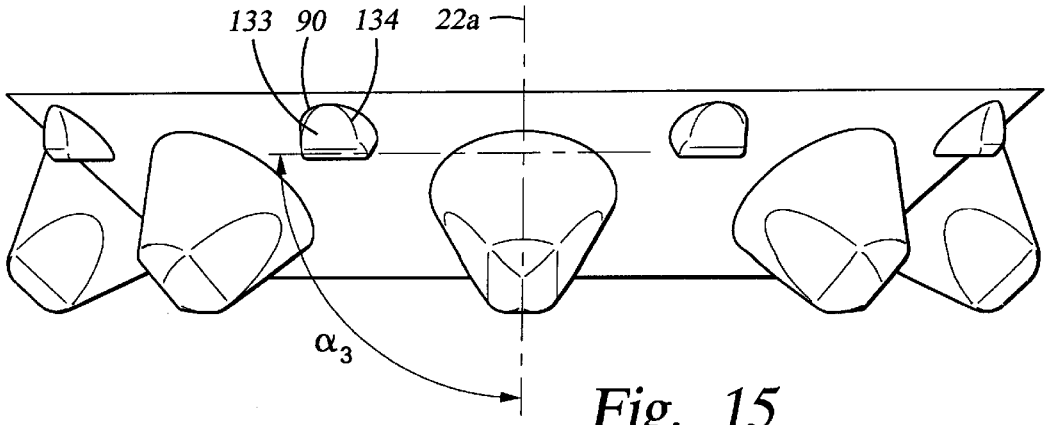
FIG. 15 is an enlarged view of part of a third alternative embodiment of a cone cutter constructed in accordance with the present invention.

Referring to all the figures that show ridge-cutting insert 90 or 90*a*, it will be understood that the protruding geometry can be any shape, such as conical, chisel, round, or flat. Also included within the possible shapes are various shapes that comprise elongated crests. The protruding geometry can also be rotated such that the chisel crest or elongated crest of the cutter element defines an angle $\alpha_3$ with respect to projection 22*a* of cone cutter axis 22 so as to present a better cutting action, as shown in FIG. 15. A chisel insert 90 or insert having a similar elongated crest is preferably positioned such that its elongated crest is rotated 90° with respect to a projection 22*a* of cone axis 22. This positions the crest of insert 90 circumferentially on the cone cutter in order to have the flank edge 134 aggressively cut the ridge. This position provides a further benefit because the flank 133 is parallel to the ridge and thus able to provide more support for the primary cutter elements when increased lateral loads are encountered. The rotation angle $\alpha_3$ can be between 0 and 180 degrees. For example, a rotation angle of 45 degrees positions the flank edge 134 aggressively, with the flank 133 somewhat relieved from cutting the ridge. Insert 90 is also preferred to have 50 percent or less projection from land 48 as compared to the primary inserts, but can be greater than 50 percent if there is sufficient intermesh clearance between the cone cutters 14–16 and inserts 90. Furthermore, any of the inserts 90, 90*a* described herein can have all or a portion of their protruding geometry coated with superabrasive coatings, such as PCD or PCBN. In addition, it is preferred that the ridge-cutting cutter element and the primary cutter element each have a base diameter and that the ridge-cutting base diameter be less than 75 percent of said primary base diameter. This corresponds to the expectation that the ridge-cutting cutter elements, including their extending portions and their bases will generally be smaller that the primary cutter elements.

What is claimed is:

1. A drill bit for cutting a formation, comprising:

a bit body having a bit axis;

a plurality of rolling cone cutters rotatable mounted on cantilevered bearing shafts on said bit body, each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage;

a second plurality of primary cutter elements extending from a second cone cutter in a second row, said second row extending to less than full gage, said second primary cutter elements overlapping said first primary cutter elements when revolved into a single plane; and at least one ridge-cutting cutter element extending from said first cone cutter and having an elongated crest oriented approximately perpendicular to a projection of the cone axis.

2. A drill bit for cutting a formation, comprising:

a bit body having a bit axis;

a plurality of rolling cone cutters rotatably mounted on cantilevered bearing shafts on said bit body, each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage;

a second plurality of primary cutter elements extending from a second cone cutter in a second row, said second row extending to less than full gage, said second primary cutter elements overlapping said first primary cutter elements when revolved into a single plane; and at least one ridge-cutting cutter element extending from said first cone cutter and having an elongated crest oriented at an angle of between 0 and 180 degrees with respect to a projection of the cone axis.

3. The drill bit in accordance with claim 2 wherein said first and second rows of primary cutter elements have cutting portions that extend out of said cone cutter and overlap when revolved into a single plane.

4. The drill bit in accordance with claim 2, further including at least one second ridge-cutting cutter element extending from said second cone cutter, said second ridge-cutting cutter element being positioned adjacent to said second row of primary cutter elements.

5. The drill bit in accordance with claim 2 wherein said ridge-cutting cutter element has a longitudinal axis and extends from said first cone cutter such that said ridge-cutting cutter element axis is angled with respect to the longitudinal axis of an adjacent primary cutter element when revolved into a single plane.

6. The drill bit in accordance with claim 2 wherein a ridge-cutting cutter element is adjacent to each primary cutter element in said first row.

7. The drill bit in accordance with claim 2 wherein said ridge-cutting cutter element is chisel shaped.

8. The bit according to claim 2 wherein said ridge-cutting cutter element crest is oriented at an angle of between 20 and 60 degrees with respect to a projection of the cone axis.

9. The bit according to claim 2 wherein said primary cutter element has an inner side and an outer side when said primary cutter element is at its closest approach to the borehole side wall and at least one of said ridge-cutting cutter elements is positioned adjacent to the outer side of a row of primary cutter elements on the same cone cutter when revolved into a single plane.

10. The bit according to claim 2 wherein said rolling cone cutter includes a land surrounding at least one row of said primary cutter elements and at least one of said ridge-cutting cutter elements is positioned on a land.

11. The drill bit in accordance with claim 2 wherein said ridge-cutting cutter element is formed integrally with the cone cutter.

12. The drill bit in accordance with claim 2 wherein said primary cutter elements are formed integrally with the cone cutter.

13. The drill bit in accordance with claim 2 wherein said first row comprises a nose row, and wherein at least one ridge-cutting cutter element is adjacent to said nose row.

14. The drill bit in accordance with claim 2 wherein said first row comprises an inner row of primary cutter elements adjacent to said gage row, and wherein at least one ridge-cutting cutter element is adjacent to said inner row.

15. The drill bit in accordance with claim 2 wherein said ridge-cutting cutter element has an extending portion having a height that is less than approximately 80 percent of the height of the extending portion of said primary cutter elements.

16. A drill bit for cutting a formation, comprising:

a bit body having a bit axis;

a plurality of rolling cone cutters rotatably mounted on cantilevered bearing shafts on said bit body, each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage;

a second plurality of primary cutter elements extending from a second cone cutter in a second row, said second row extending to less than full gage, said second primary cutter elements overlapping said first primary cutter elements when revolved into a single plane; and at least one ridge-cutting cutter element extending from said first cone cutter;

wherein at least one rolling cone cutter includes a land surrounding at least one row of said primary cutter elements and a groove adjacent said land, and at least one of said ridge-cutting cutter elements is completely positioned in said groove.

17. A drill bit for cutting a formation, comprising:

a bit body having a bit axis;

a plurality of rolling cone cutters rotatable mounted on cantilevered bearing shafts on said bit body, each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage;

a second plurality of primary cutter elements extending from a second cone cutter in a second row, said second row extending to less than full gage said second primary cutter elements overlapping said first primary cutter elements when revolved into a single plane; and at least one ridge-cutting cutter element extending from said first cone cutter;

wherein at least one rolling cone cutter includes a land surrounding at least one row of said primary cutter elements and a groove adjacent said land, and at least one of said ridge-cutting cutter elements is positioned partially in said groove.

18. A drill bit for cutting a formation, comprising:

a bit body having a bit axis;

a plurality of rolling cone cutters rotatable mounted on cantilevered bearing shafts on said bit body each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage;

a second plurality of primary cutter elements extending from a second cone cutter in a second row, said second row extending to less than full gage, said second primary cutter elements overlapping said first primary cutter elements when revolved into a single plane; and at least one ridge-cutting cutter element extending from said first cone cutter;

wherein said rolling cone cutter includes a land surrounding at least one row of said primary cutter elements, a groove adjacent said land, and a flat between said land and said groove, and at least one of said ridge-cutting cutter elements is positioned at least partially on a flat.

19. A drill bit for cutting a borehole, comprising:

a bit body having a bit axis;

at least two rolling cone cutters rotatably mounted on cantilevered bearing shafts on said bit body, each rolling cone cutter having a generally conical surface;

a plurality of gage row primary cutter elements extending from one of said cone cutters in a gage row;

at least one primary cutter element extending from one of said cone cutters in an outermost first row, said first row extending to less than gage diameter, said first row primary cutter element having an outer side and an inner side when said primary cutter element is at its closest approach to the borehole side wall; and at least one ridge-cutting cutter element extending from the same cone cutter as said first row, said ridge-cutting cutter element being positioned adjacent to said outer side of said first row when revolved into a single plane.

20. The drill bit in accordance with claim 19, said second row being the next row in from said first row as measured from the gage curve, said second row primary cutter element having an outer side and an inner side when said second row primary cutter element is at its closest approach to the borehole side wall, and further including at least a second ridge-cutting cutter element extending from said second cone cutter, said second ridge-cutting cutter element being positioned adjacent to said outer side of said second row primary cutter element when revolved into a single plane.

21. The drill bit in accordance with claim 19 wherein said ridge-cutting cutter element has a longitudinal axis and extends from said first cone cutter such that said ridge-cutting cutter element axis is not parallel to the axis of said primary cutter element when revolved into a single plane.

22. The bit according to claim 19 wherein said ridge-cutting cutter element has an elongated crest.

23. The bit according to claim 22 wherein said ridge-cutting cutter element is chisel shaped.

24. The bit according to claim 22 wherein said ridge-cutting cutter element has its crest oriented approximately perpendicular to a projection of the cone axis.

25. The bit according to claim 22 wherein said ridge-cutting cutter element has its crest oriented at an angle of between 0 and 180 degrees with respect to a projection of the cone axis.

26. The bit according to claim 22 wherein said ridge-cutting cutter element has its crest oriented at an angle of between 20 and 60 degrees with respect to a projection of the cone axis.

27. The bit according to claim 19 wherein rolling cone cutter includes a land surrounding at least one row of said primary cutter elements and at least one ridge-cutting cutter element is positioned on a land.

28. The bit according to claim 19 wherein said rolling cone cutter includes a land surrounding at least one row of said primary cutter elements, a groove adjacent said land, and a flat between said land and said groove, and at least one ridge-cutting cutter element is positioned at least partially on a flat.

29. The bit according to claim 19 wherein said ridge-cutting cutter element is formed integrally with the cone cutter.

30. The bit according to claim 19 wherein said primary cutter element is formed integrally with the cone cutter.

31. The drill bit according to claim 19 wherein said first row comprises a nose row, and wherein at least one ridge-cutting cutter element is adjacent to said nose row.

32. The drill bit according to claim 19 wherein said first row comprises an inner row of primary cutter elements adjacent to said gage row, and wherein at least one ridge-cutting cutter element is adjacent to said inner row.

33. The bit according to claim 19 wherein said ridge-cutting cutter element is at least partially coated with a superabrasive material.

34. The bit according to claim 33 wherein said superabrasive material is PCD.

35. The bit according to claim 19 wherein said ridge-cutting cutter element and said primary cutter element each have a base diameter and said ridge-cutting base diameter is less than 75 percent of said primary base diameter.

36. A drill bit for cutting a borehole, comprising:

a bit body having a bit axis;

at least two rolling cone cutters rotatable mounted on cantilevered bearing shafts on said bit body, each rolling cone cutter having a generally conical surface;

a plurality of gage row primary cutter elements extending from one of said cone cutters in a gage row;

at least one primary cutter element extending from one of said cone cutters, in a first row, said first row extending to less than gage diameter, said first row primary cutter element having an outer side and an inner side when said primary cutter element is at its closest approach to the borehole side wall; and at least one ridge-cutting cutter element extending from one of said cone cutters, said ridge-cutting cutter element being positioned adjacent to said outer side of said first row primary cutter element on the same cone cutter when revolved into a single plane;

wherein said ridge-cutting cutter element has a flank oriented to reduce recirculation of fluid around said primary cutter element.

37. A drill bit for cutting a borehole, comprising:

a bit body having a bit axis;

at least two rolling cone cutters rotatable mounted on cantilevered bearing shafts on said bit body, each rolling cone cutter having a generally conical surface;

a plurality of gage row primary cutter elements extending from one of said cone cutters in a gage row;

at least one primary cutter element extending from one of said cone cutters in a first row, said first row extending to less than gage diameter, said first row primary cutter element having an outer side and an inner side when said primary cutter element is at its closest approach to the borehole side wall; and at least one ridge-cutting cutter element extending from one of said cone cutters, said ridge-cutting cutter element being positioned adjacent to said outer side of said first row primary cutter element on the same cone cutter when revolved into a single plane;

wherein said ridge-cutting cutter element has an edge oriented to reduce recirculation of fluid around said primary cutter element.

38. A drill bit for cutting a borehole, comprising:

a bit body having a bit axis;

at least two rolling cone cutters rotatable mounted on cantilevered bearing shafts on said bit body, each rolling cone cutter having a generally conical surface;

a plurality of gage row primary cutter elements extending from one of said cone cutters in a gage row;

at least one primary cutter element extending from one of said cone cutters in a first row, said first row extending to less than gage diameter, said first row primary cutter element having an outer side and an inner side when said primary cutter element is at its closest approach to the borehole side wall; and at least one ridge-cutting cutter element extending from one of said cone cutters, said ridge-cutting cutter element being positioned adjacent to said outer side of said first row primary cutter element on the same cone cutter when revolved into a single plane;

wherein said rolling cone cutter includes a land surrounding at least one row of said primary cutter elements and a groove adjacent said land, and at least one ridge-cutting cutter element is positioned completely in said groove.

39. A drill bit for cutting a borehole, comprising:

a bit body having a bit axis;

at least two rolling cone cutters rotatably mounted on cantilevered bearing shafts on said bit body, each rolling cone cutter having a generally conical surface;

a plurality of gage row primary cutter elements extending from one of said cone cutters in a gage row;

at least one primary cutter element extending from one of said cone cutters in a first row, said first row extending to less than gage diameter, said first row primary cutter element having an outer side and an inner side when said primary cutter element is at its closest approach to the borehole side wall; and at least one ridge-cutting cutter element extending from one of said cone cutters, said ridge-cutting cutter element being positioned adjacent to said outer side of said first row primary cutter element on the same cone cutter when revolved into a single plane;

wherein said rolling cone cutter includes a land surrounding at least one row of said primary cutter elements and a groove adjacent said land, and at least one ridge-cutting cutter element is positioned partially in said groove.

40. A drill bit for cutting a formation, comprising:

a bit body having a bit axis;

at least one rolling cone cutter rotatable mounted on cantilevered bearing shafts on said bit body, each rolling cone cutter having a generally conical surface;

a plurality of gage row primary cutter elements extending from one of said cone cutters in a gage row;

at least one primary cutter element extending from said cone cutter in a first row, said first row extending to less than gage diameter, said primary cutter element having an outer side and an inner side when said primary cutter element is at its closest approach to the borehole side wall; and at least one ridge-cutting cutter element extending from said rolling cone cutter, said ridge-cutting cutter element being positioned adjacent to said outer side of said first row when revolved into a single plane and having an elongated crest oriented approximately perpendicular to a projection of the cone axis.

41. A drill bit for cutting a formation, comprising:

a bit body having a bit axis;

at least one rolling cone cutter rotatable mounted on cantilevered bearing shafts on said bit body, each rolling cone cutter having a generally conical surface;

a plurality of gage row primary cutter elements extending from one of said cone cutters in a gage row;

at least one primary cutter element extending from said cone cutter in a first row, said first row extending to less than gage diameter, said primary cutter element having an outer side and an inner side when said primary cutter element is at its closest approach to the borehole side wall; and at least one ridge-cutting cutter element extending from said rolling cone cutter, said ridge-cutting cutter element being positioned adjacent to said outer side of said first row when revolved into a single plane and having an elongated crest oriented at an angle of between 0 and 180 degrees with respect to a projection of the cone axis.

42. The bit according to claim 41 wherein said ridge-cutting cutter element has its crest oriented at an angle of between 20 and 60 degrees with respect to a projection of the cone axis.

43. The bit according to claim 41 wherein said ridge-cutting cutter element is formed integrally with the cone cutter.

44. The bit according to claim 41 wherein said primary cutter element is formed integrally with the cone cutter.

45. The bit according to claim 41 wherein said ridge-cutting cutter element is at least partially coated with a superabrasive material.

46. The bit according to claim 45 wherein said superabrasive material is PCD.

47. The bit according to claim 41 wherein said ridge-cutting cutter element and said primary cutter element each have a base diameter and said ridge-cutting base diameter is less than 75 percent of said primary base diameter.

48. A drill bit for cutting a formation, comprising:

a bit body having a bit axis;

a plurality of rolling cone cutters rotatably mounted on cantilevered bearing shafts on said bit body, each rolling cone cutter having a generally conical surface;

a plurality of gage row primary cutter elements extending from one of said cone cutters in a gage row, said gage row extending to full gage;

a first plurality of primary cutter elements extending from a first of said cone cutters in a first row, said first row extending to less than full gage; and at least one ridge-cutting cutter element extending from said first cone cutter, said ridge-cutting cutter element being positioned such that its extending portion is eclipsed by at least one primary cutter element when revolved into a single plane.

49. The drill bit in accordance with claim 48, further including a second plurality of primary cutter elements extending from a second cone cutter in a second row, said second row extending to less than full gage, said second primary cutter elements overlapping said first primary cutter elements when revolved into a single plane.

50. The drill bit in accordance with claim 49, further including a second ridge-cutting cutter element extending from said second cone cutter, said second ridge-cutting cutter element being positioned adjacent to said second row of primary cutter elements.

51. The drill bit in accordance with claim 49 wherein at least one ridge-cutting cutter element has a longitudinal axis and extends from said first cone cutter such that said ridge-cutting cutter element axis is angled with respect to the longitudinal axis of an adjacent primary cutter element when revolved into a single plane.

52. The drill bit according to claim 48 wherein a ridge-cutting cutter element is adjacent to each primary cutter element in said first row.

53. The bit according to claim 48 wherein said ridge-cutting cutter element has an elongated crest.

54. The bit according to claim 48 wherein said primary cutter element has an inner side and an outer side when said primary cutter element is at its closest approach to the borehole side wall and at least one ridge-cutting cutter element is positioned adjacent to the outer side of a row of primary cutter elements on the same cone cutter when revolved into a single plane.

55. The bit according to claim 48 wherein said ridge-cutting cutter element is formed integrally with the cone cutter.

56. The bit according to claim 48 wherein said primary cutter elements are formed integrally with the cone cutter.

57. The drill bit according to claim 48 wherein said first row comprises a nose row, and wherein said ridge-cutting cutter element is adjacent to said nose row primary cutter elements.

58. The drill bit according to claim 48 wherein said first row comprises an inner row of primary cutter elements adjacent to said gage row, and wherein said ridge-cutting cutter element is adjacent to said inner row primary cutter elements.

59. The drill bit according to claim 48 wherein said ridge-cutting cutter element has an extending portion that is less than approximately 80 percent of the height of the extending portion of said primary cutter elements.

* * * * *